US011812858B1

(12) United States Patent
Plemmons

(10) Patent No.: US 11,812,858 B1
(45) Date of Patent: Nov. 14, 2023

(54) PROGRAMMABLE ROCKING BED

(71) Applicant: Clay Plemmons, Candler, NC (US)

(72) Inventor: Clay Plemmons, Candler, NC (US)

( * ) Notice: Subject to any disclaimer, the term of this patent is extended or adjusted under 35 U.S.C. 154(b) by 309 days.

(21) Appl. No.: 16/996,994

(22) Filed: Aug. 19, 2020

(51) Int. Cl.
*A47C 21/00* (2006.01)

(52) U.S. Cl.
CPC ..... *A47C 21/006* (2013.01); *A47C 21/003* (2013.01)

(58) Field of Classification Search
CPC ..... A47C 21/006; A47C 21/00
USPC ..... 5/609
See application file for complete search history.

(56) References Cited

U.S. PATENT DOCUMENTS 5,083,072 A * 1/1992 Song ..... G05B 19/232 318/632
5,165,126 A * 11/1992 Jones ..... A47C 21/003 5/904
5,243,868 A 9/1993 Schonberger
6,984,057 B1 * 1/2006 Rogers ..... A47B 97/00 362/253
7,478,446 B2 1/2009 Sims, Jr.
8,707,477 B1 4/2014 Flemister
8,863,325 B1 10/2014 Fiterson
9,933,775 B2 * 4/2018 Saavedra ..... A61G 7/0573
10,342,358 B1 * 7/2019 Palashewski ..... A61G 7/018
10,905,249 B1 * 2/2021 Saghiri ..... A61B 5/6892
2002/0126475 A1 * 9/2002 Washburn ..... F21V 33/0012 362/228
2003/0098685 A1 * 5/2003 Blaettner ..... H02K 29/08 324/174
2007/0283500 A1 * 12/2007 Chang ..... A47C 21/003 5/713
2008/0052830 A1 * 3/2008 Koughan ..... A47C 19/005 5/660
2008/0165481 A1 * 7/2008 Kirschner ..... A47C 19/022 361/728
2009/0177327 A1 * 7/2009 Turner ..... A47C 21/003 5/616
2011/0138534 A1 * 6/2011 Kozel ..... A47C 19/00 5/499
2012/0137444 A1 * 6/2012 Wong ..... A47C 21/006 5/722
2013/0191993 A1 * 8/2013 Rawls-Meehan ..... A61G 7/018 5/617
2013/0200832 A1 * 8/2013 Oh ..... H02P 6/16 318/400.37
2014/0061425 A1 * 3/2014 Eoh ..... F16M 11/2014 248/479
2015/0025688 A1 * 1/2015 Hille ..... A47C 20/041 700/275

(Continued)

FOREIGN PATENT DOCUMENTS

WO 2007053416 5/2007
WO 2015076853 5/2015

*Primary Examiner* — Justin C Mikowski
*Assistant Examiner* — Luke Hall
(74) *Attorney, Agent, or Firm* — Kyle A. Fletcher, Esq.

(57) ABSTRACT

The programmable rocking bed includes a mattress support box, a plurality of jacks, a base box frame, a mattress, a headboard, a footboard, a controller, a plurality of light strips, and one or more sound systems. The mattress support box may be position agile via the activation of the plurality of jacks. The plurality of jacks may be operable to create a static or dynamic repositioning of the mattress support box.

12 Claims, 5 Drawing Sheets

(56) References Cited

U.S. PATENT DOCUMENTS

| | | | | |
|---|---|---|---|---|
| 2015/0128343 | A1* | 5/2015 | Katz | H04R 1/025 5/279.1 |
| 2017/0221335 | A1* | 8/2017 | Brillaud | A61B 5/1115 |
| 2017/0360210 | A1* | 12/2017 | Risdon | A47C 19/022 |
| 2018/0220803 | A1* | 8/2018 | Blueford | G08B 25/10 |
| 2019/0231079 | A1* | 8/2019 | Schulte | A47C 31/008 |
| 2019/0290011 | A1 | 9/2019 | Spri | |
| 2019/0313803 | A1* | 10/2019 | Liu | H05B 45/20 |
| 2020/0110194 | A1* | 4/2020 | Young | A61B 5/1115 |
| 2020/0138200 | A1* | 5/2020 | Sharma | A47C 21/044 |
| 2020/0214459 | A1* | 7/2020 | Venditto | A47C 19/22 |
| 2020/0350846 | A1* | 11/2020 | Elmaanaoui | H02P 6/21 |
| 2021/0112990 | A1* | 4/2021 | Rizzo | A47C 19/22 |
| 2021/0120962 | A1* | 4/2021 | Lin | A61B 5/0205 |
| 2021/0204708 | A1* | 7/2021 | Ludlum | G06F 3/167 |
| 2021/0401184 | A1* | 12/2021 | Manwaring | A47C 21/006 |

* cited by examiner

PROGRAMMABLE ROCKING BED

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of beds, more specifically, a programmable rocking bed.

SUMMARY OF INVENTION

The programmable rocking bed comprises a mattress support box, a plurality of jacks, a base box frame, a mattress, a headboard, a footboard, a controller, a plurality of light strips, and one or more sound systems. The mattress support box may be position agile via the activation of the plurality of jacks. The plurality of jacks may be operable to create a static or dynamic repositioning of the mattress support box. As a non-limiting example, a left head jack and a right head jack located adjacent to the headboard may be extended higher than a left foot jack and a right foot jack located adjacent to the footboard such that the mattress is inclined with the head of a user higher than the feet of the user. The user may select, via the controller, a program of motion, sound, and lighting to create a desired sleeping environment.

An object of the invention is to vary the elevation, inclination angle, and/or tilt angle of a frame and mattress.

Another object of the invention is to provide a plurality of light strips operable to create mood lighting.

A further object of the invention is to provide one or more sound systems to play an audio program, music, and/or sound effects.

Yet another object of the invention is to provide a controller that may operate the plurality of jacks, lights strips, and sound systems to produce a coordinated program of motion, light, and sound.

These together with additional objects, features and advantages of the programmable rocking bed will be readily apparent to those of ordinary skill in the art upon reading the following detailed description of the presently preferred, but nonetheless illustrative, embodiments when taken in conjunction with the accompanying drawings.

In this respect, before explaining the current embodiments of the programmable rocking bed in detail, it is to be understood that the programmable rocking bed is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the programmable rocking bed.

It is therefore important that the claims be regarded as including such equivalent construction insofar as they do not depart from the spirit and scope of the programmable rocking bed. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
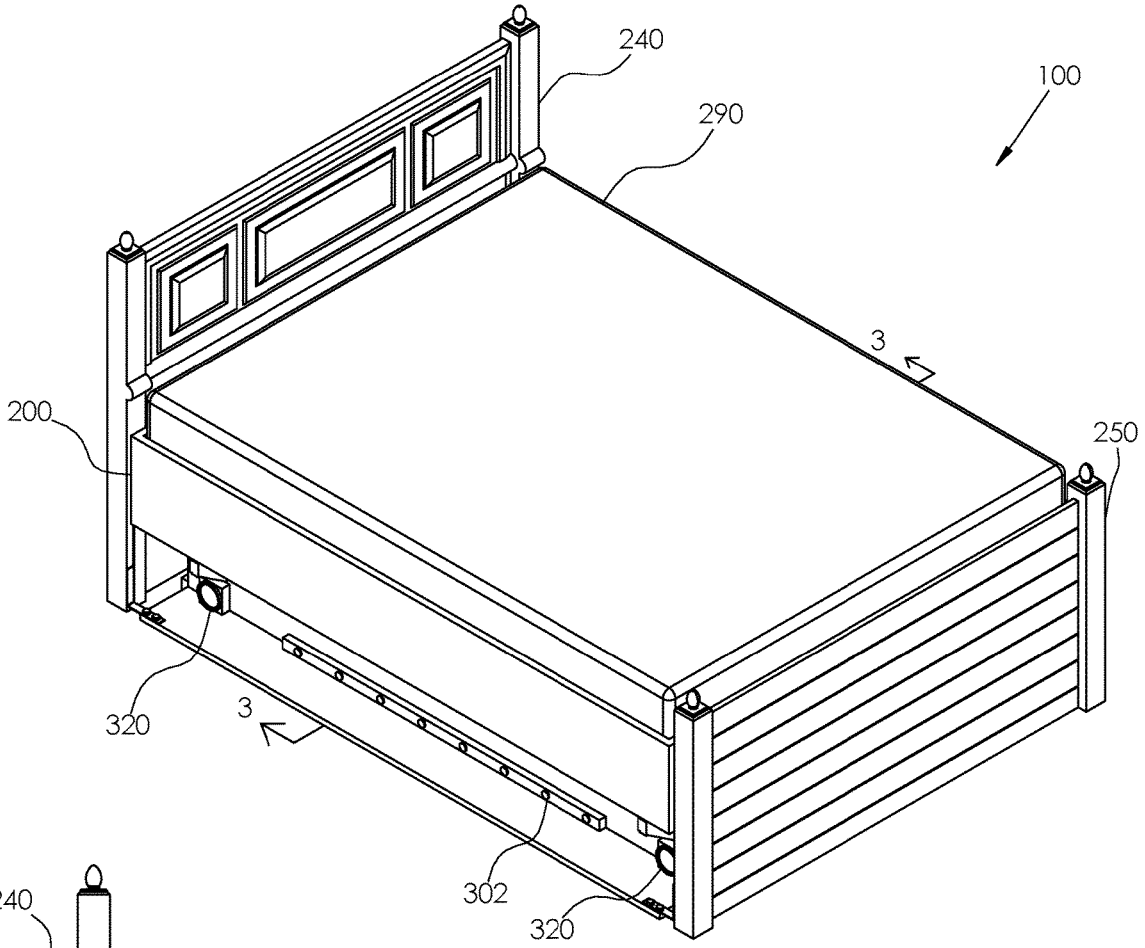
FIG. 1 is an isometric view of an embodiment of the disclosure.
Figure 2:
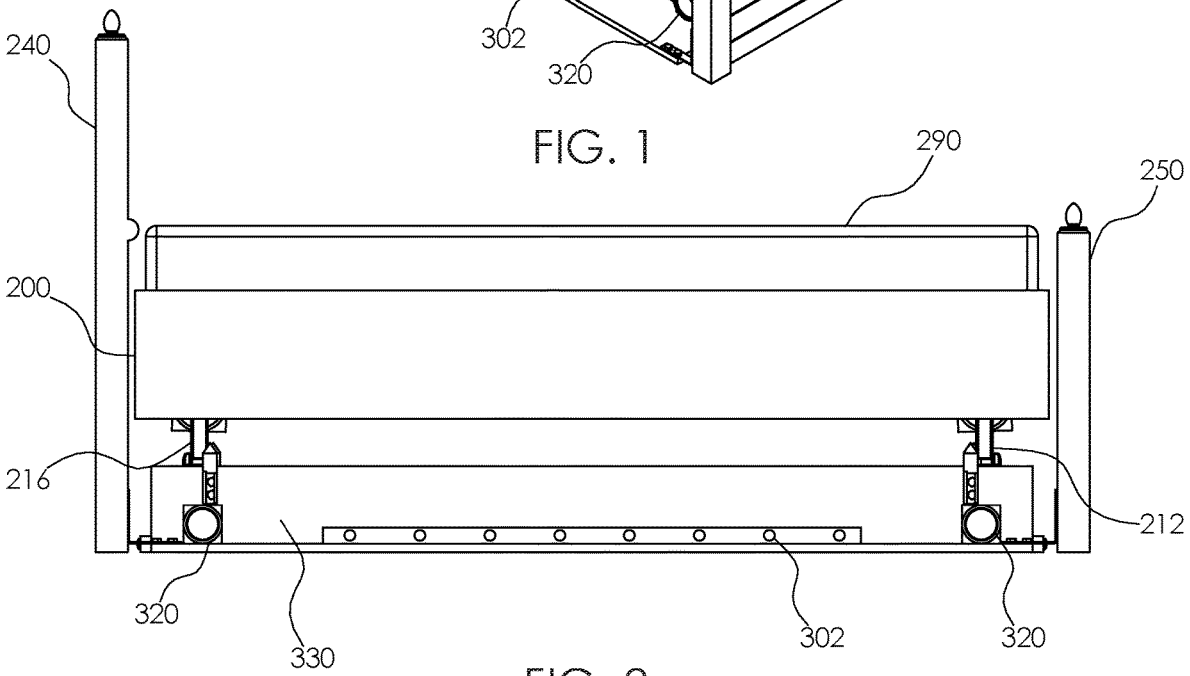
FIG. 2 is a side view of an embodiment of the disclosure.
Figure 3:
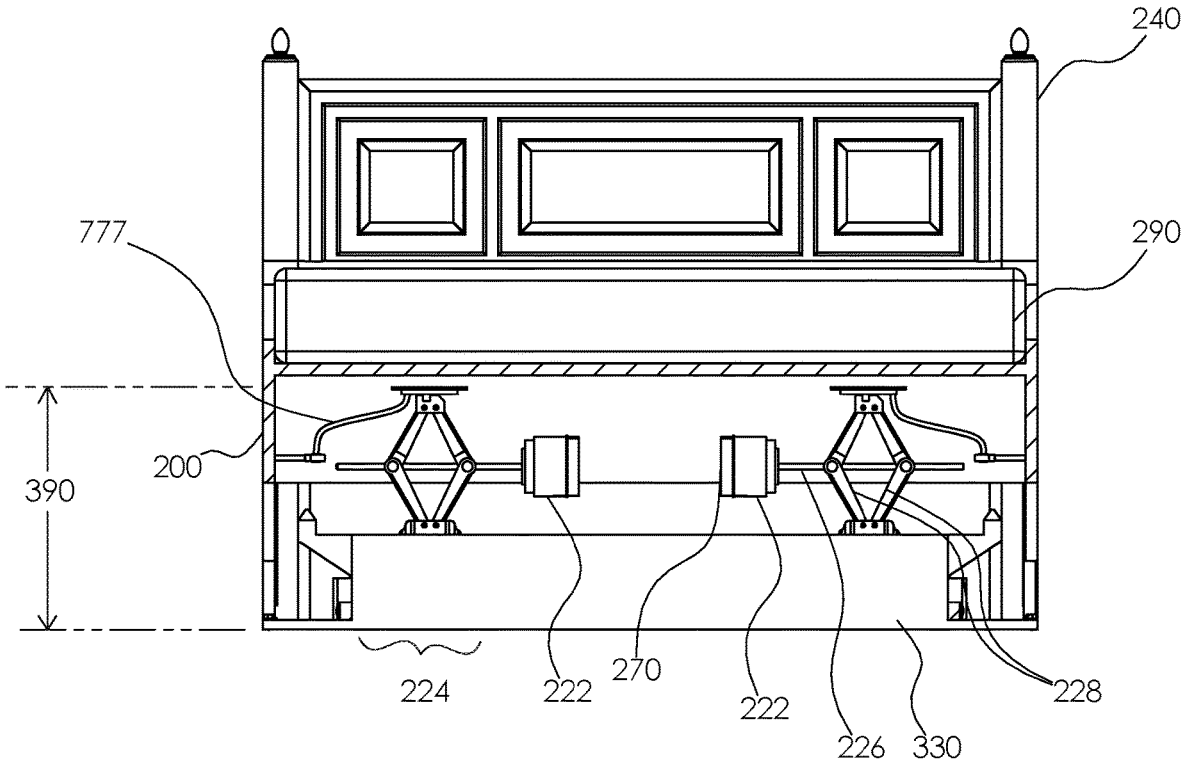
FIG. 3 is a cross-sectional view of an embodiment of the disclosure across 3-3 as shown in FIG. 1.
Figure 4:
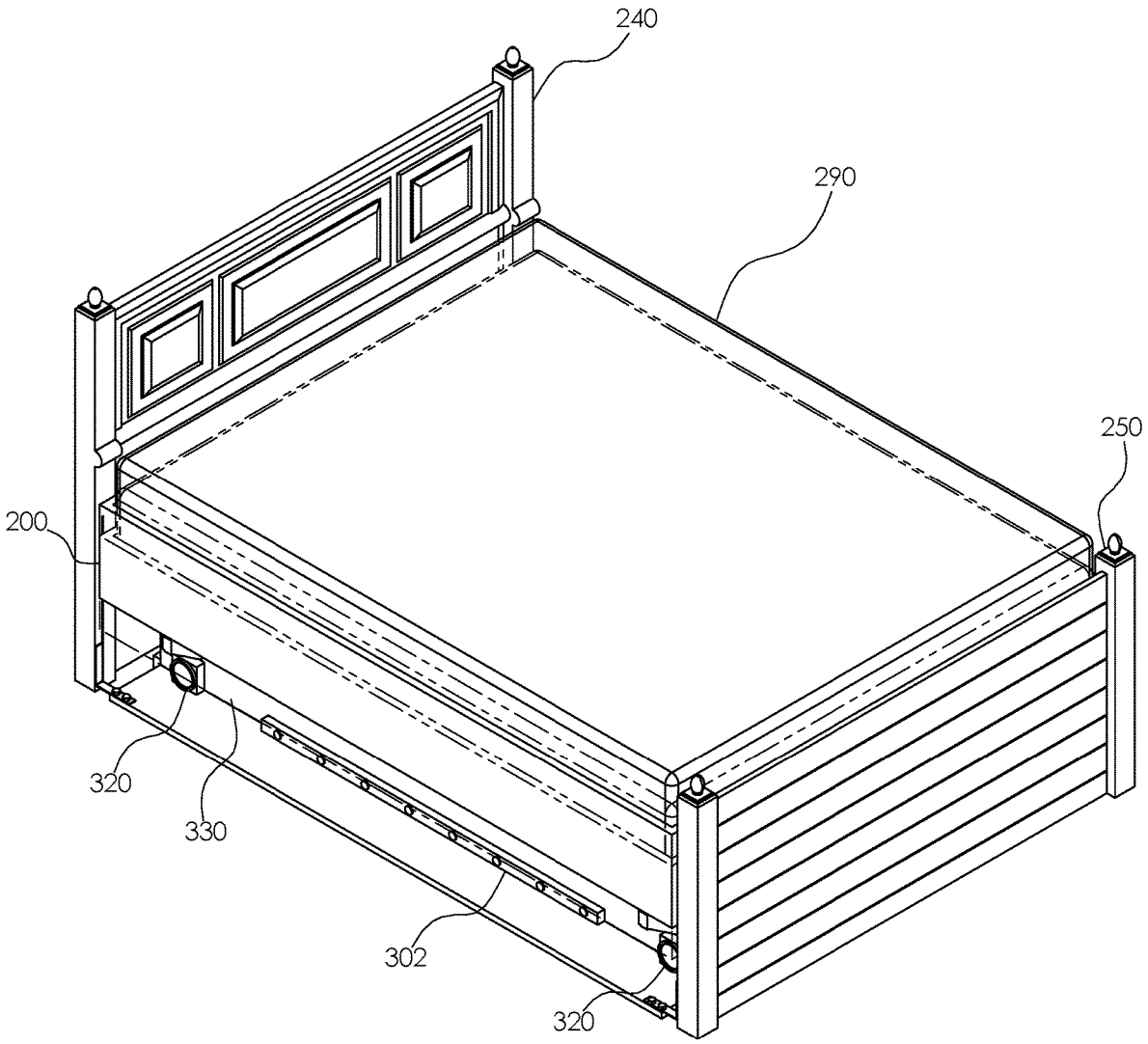
FIG. 4 is an isometric view of an embodiment of the disclosure illustrating a change in the elevation of the mattress.
Figure 5:
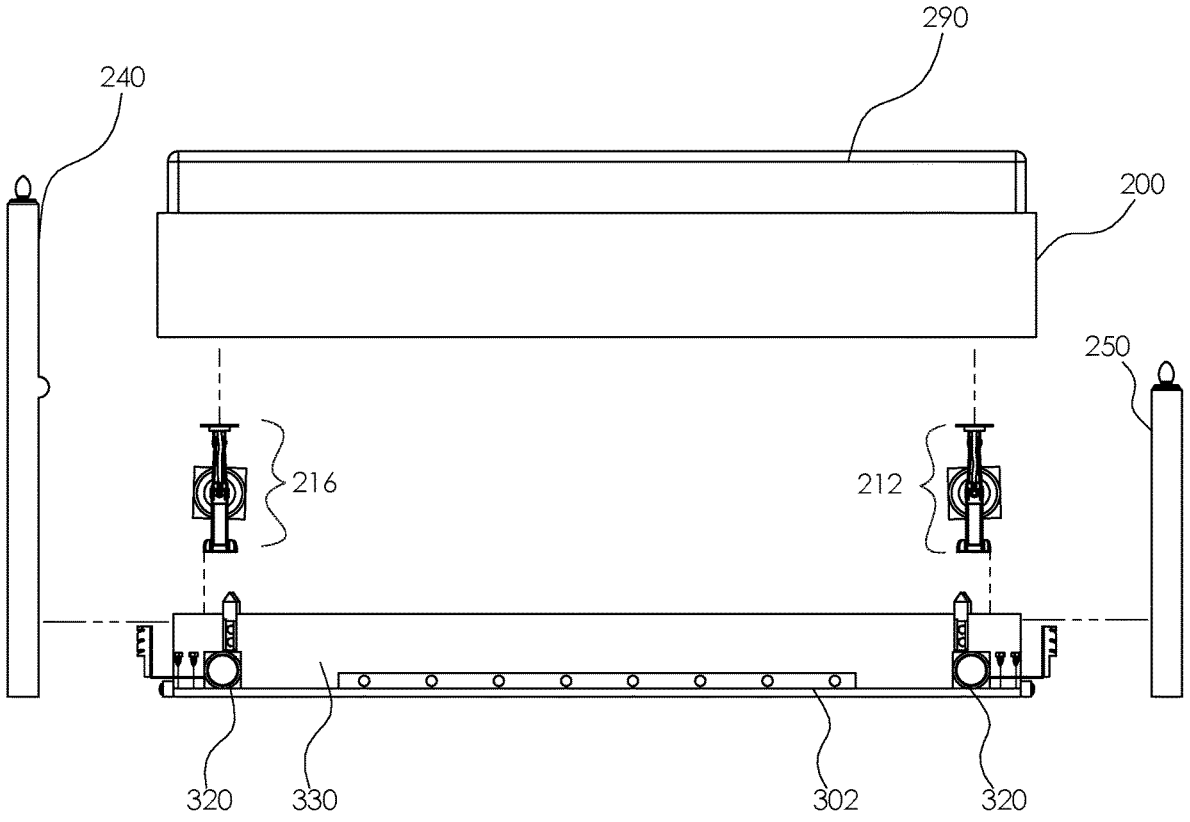
FIG. 5 is an exploded view of an embodiment of the disclosure.
Figure 6:
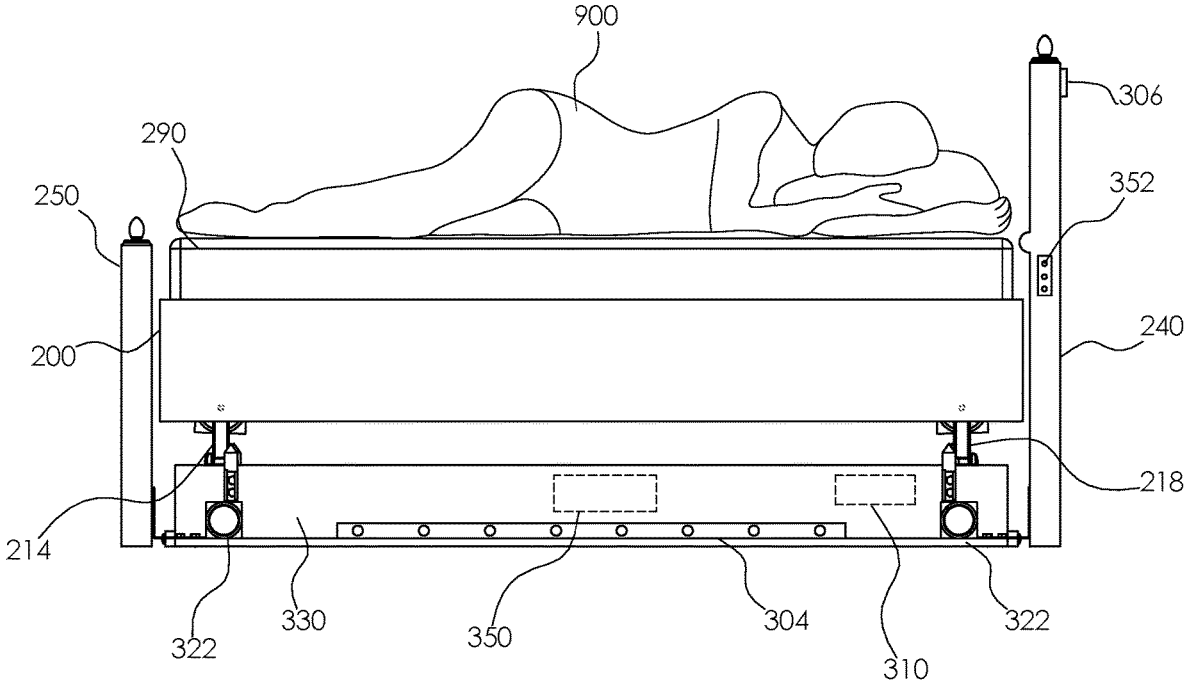
FIG. 6 is an in-use view of an embodiment of the disclosure.

Detailed reference will now be made to a first potential embodiment of the disclosure, which is illustrated in FIGS. 1 through 6.

The programmable rocking bed 100 (hereinafter invention) comprises a mattress support box 200, a plurality of jacks, a base box frame 330, a mattress 290, a headboard 240, a footboard 250, a controller 350, a plurality of light strips, and one or more sound systems 310. The mattress support box 200 may be position agile via the activation of the plurality of jacks. The plurality of jacks may be operable to create a static or dynamic repositioning of the mattress support box 200. As a non-limiting example, a left head jack 216 and a right head jack 218 located adjacent to the headboard 240 may be extended higher than a left foot jack 212 and a right foot jack 214 located adjacent to the footboard 250 such that the mattress 290 is inclined with the head of a user 900 higher than the feet of the user 900.

The mattress support box 200 may support the mattress 290 in a position elevated above a supporting surface. The mattress 290 may be adapted for the user 900 to lay upon. As a non-limiting example, the supporting surface may be a floor.

The plurality of jacks may comprise the left foot jack 212, the right foot jack 214, the left head jack 216, and the right head jack 218. The left foot jack 212 may be located under the left, foot of the mattress 290. The top of the left foot jack 212 may couple to the bottom of the mattress support box 200. The bottom of the left foot jack 212 may be coupled to the top of the base box frame 330. The right foot jack 214 may be located under the right, foot of the mattress 290. The top of the right foot jack 214 may couple to the bottom of the mattress support box 200. The bottom of the right foot jack 214 may be coupled to the top of the base box frame 330. The left head jack 216 may be located under the left, head of the mattress 290. The top of the left head jack 216 may couple to the bottom of the mattress support box 200. The bottom of the left head jack 216 may be coupled to the top of the base box frame 330. The right head jack 218 may be located under the right, head of the mattress 290. The top of the right head jack 218 may couple to the bottom of the mattress support box 200. The bottom of the right head jack 218 may be coupled to the top of the base box frame 330.

An individual jack selected from the left foot jack 212, the right foot jack 214, the left head jack 216, and the right head jack 218 may change an elevation 390 of the corresponding corner of the mattress support box 200. The individual jack may comprise a servo motor 222 and a scissor jack 224. The servo motor 222 may be energized with an electrical potential that may cause the servo motor 222 to turn in a first rotational direction or to turn in a second rotational direction. The scissor jack 224 may raise the mattress support box 200 when the servo motor 222 turns in the first rotational direction. The scissor jack 224 may lower the mattress support box 200 when the servo motor 222 turns in the second rotational direction. In some embodiments, the electrical potential energizing the servo motor 222 may have a first polarity to cause the servo motor 222 to turn in the first rotational direction and may have a second polarity to cause the servo motor 222 to turn in the second rotational direction. In some embodiments, the electrical potential energizing the servo motor 222 may be pulsed to encode the direction and speed that the servo motor 222 must turn. The servo motor 222 may turn a jack screw 226. The jack screw 226 may pull the hinged center of a plurality of jack armatures 228 together when the jack screw 226 turns in the first rotational direction, causing the individual jack to gain height. The jack screw 226 may push the hinged center of the plurality of jack armatures 228 apart when the jack screw 226 turns in the second rotational direction, causing the individual jack to lose height.

It shall be noted that the "coupling" of the jack to the various locations around the mattress support box 200 may involve a member 777. The member 777 may be a cable or a bracket that attaches between the top of the respective jack and the mattress support box 200. Moreover, the member 777 enables swaying motion of the mattress support box 200 to occur relative to the various jacks in order to simulate a rocking motion. In this scenario, the member 777 may be further characterized as a left foot member that works with the left foot jack 212; a right foot member that works with the right foot jack 214; a left head member that works with the left head jack 216; and a right head member that works with the right head jack 218.

The elevation 390 of a subset of the plurality of jacks may be changed simultaneously to change an inclination angle or a tilt angle of the mattress 290. The inclination angle is defined to be the angle measured between a longitudinally-oriented line that is parallel to the supporting surface and a longitudinally-oriented line across the top of the mattress support box 200. The tilt angle is defined to be the angle measured between a laterally-oriented that is parallel to the supporting surface and a laterally-oriented line across the top of the mattress support box 200. As a non-limiting example, the elevation 390 of the left foot jack 212 and the right foot jack 214 may be changed simultaneously and in the same direction or the elevation 390 of the left head jack 216 and the right head jack 218 may be changed simultaneously and in the same direction in order to raise or lower head or foot of the mattress 290, thus changing the inclination angle of the mattress 290. Alternatively, the elevation 390 of the left foot jack 212, the right foot jack 214, the left head jack 216 and the right head jack 218 may all be changed simultaneously with the elevation 390 of the left foot jack 212 and the right foot jack 214 changing in one direction while the elevation 390 of the left head jack 216 and the right head jack 218 are changed in the opposite direction in order to raise or lower head or foot of the mattress 290.

As a non-limiting example, the elevation 390 of the left foot jack 212 and the left head jack 216 may be changed simultaneously and in the same direction or the elevation 390 of the right foot jack 214 and the right head jack 218 may be changed simultaneously and in the same direction in order to tilt the mattress 290 to one side or the other. Alternatively, the elevation 390 of the left foot jack 212, the right foot jack 214, the left head jack 216 and the right head jack 218 may all be changed simultaneously with the elevation 390 of the left foot jack 212 and the left head jack 216 changing in one direction while the elevation 390 of the right foot jack 214 and the right head jack 218 are changed in the opposite direction in order to tilt the mattress 290 to one side or the other.

The elevation 390 of the left foot jack 212, the right foot jack 214, the left head jack 216 and the right head jack 218 may all be changed simultaneously and in the same direction in order to raise or lower the height of the mattress 290.

The elevation 390 of the plurality of jacks may be adjusted continuously over a time period measurable in minutes and seconds to create dynamic motion of the mattress 290. As a non-limiting example, the plurality of jacks may raise and lower alternating side of the mattress 290 to simulate the rocking motion of sleeping in a berth on a ship and/or a baby being rocked to sleep in a mother's arms. This motion may also aid in allowing the increased ability to breath freely counter act sleep apnea.

The headboard 240 and the footboard 250 may be coupled to the base box frame 330 at opposing longitudinal ends of the base box frame 330. As non-limiting examples, the headboard 240 and the footboard 250 may be coupled to the base box frame 330 via a plurality of brackets.

The controller 350 may operate the servo motors 222 at each of the plurality of jacks, the plurality of light strips, and the one or more sound systems 310. The controller 350 may be adapted for the user 900 to direct operation of the controller 350 via a set of operator controls 352. As non-limiting examples, the set of operator controls 352 may comprise controls to select one or more static elevations of the plurality of jacks, one or more repeating motion patterns, one or more lighting effects, one or more audio programs, or combinations thereof. In some embodiments, the set of operator controls 352 may be accessible at one or more locations on the headboard 240. In some embodiments, a hall sensor 270 located on the servo motor 222 of each of the individual jacks may provide input to the controller 350 regarding the position of the servo motor 222, rotational speed of the servo motor 222, rotational direction of the servo motor 222, or combinations thereof. As a non-limiting example, the controller 350 may be able to determine the height of each of the individual jacks using information supplied by the hall sensors 270.

The controller 350 may also be attached to an oxygen sensor to monitor oxygen levels in a person sleeping in the bed. A program may be used to monitor these levels, and can tilt the bed to improve the person's breathing as needed.

The plurality of light strips may be operable to create mood lighting. The intensity and hue of the plurality of light strips may be established by the controller 350. The intensity and hue may be set and remain static. Alternatively, the intensity and hue may be continuously modified by the controller 350 to create a dynamic light display. In some embodiments, the plurality of light strips may comprise a left light strip 302 and a right light strip 304. The left light strip 302 and the right light strip 304 may be coupled to the left and right side of the base box frame 330, respectively. The left light strip 302 and the right light strip 304 may shine upon the floor beneath the mattress support box 200. In some embodiments, the plurality of light strips may further comprise a head wall light strip 306. The head wall light strip 306 may be coupled to the headboard 240 or to the base box frame 330 at a location behind the headboard 240 such that the head wall light strip 306 shines upon a wall that is adjacent the headboard 240.

The one or more sound systems 310 may comprise one or more speakers, one or more amplifiers, or combinations thereof. The one or more sound systems 310 may produce an audio program that may augment the effect of motion produced by the plurality of jacks and lighting effects produced by the plurality of light strips. In some embodiments, the one or more sound systems 310 may comprise a left sound system 320 and a right sound system 322 such that the audio program may be played in stereo.

In use, the user 900 may establish the elevation 390 of the plurality of jacks, and therefore the mattress 290, via the controller 350. The user 900 may change the elevation 390 of any of all of the plurality of jacks via the controller 350. As a non-limiting example, the user 900 may mitigate nighttime GERD (gastroesophageal reflux disease) by raising the elevation 390 of the left head jack 216 and the right head jack 218, by lowering the elevation 390 of the left foot jack 212 and the right foot jack 214, or both. The user 900 may select, via the controller 350, a program of motion, sound, and lighting to create a desired sleeping environment. As a non-limiting example, a gentle side-to-side rocking of the mattress 290 by the plurality of jacks, ocean noises played via the one or more sound systems 310, and bluish green lighting from the plurality of light strips may be suggestive of sleeping aboard a ship.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "amplifier" may refer to an electronic component that increases voltage, current, or power level of an input signal.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used in this disclosure, the word "correspond" indicates that a first object is in some manner linked to a second object in a one to one relationship or that one or more properties shared by two or more objects match, agree, or align within acceptable manufacturing tolerances.

As used herein, the words "couple", "couples", "coupled" or "coupling", may refer to connecting, either directly or indirectly, and does not necessarily imply a mechanical connection.

As used herein, the words "data" and "information" may be used interchangeably to refer to raw, unprocessed facts and to facts that have been processed, structured, organized, or presented in a context that makes the facts useful.

As used herein, the word "desired" may refer to a specific value or action within a range of supported values or action. A "desired" value or action may indicate that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, "elevation" may refer to the span of the distance between a horizontal surface and a support surface as measured in the direction opposite to the force of gravity.

As used herein, "rocking" may refer to a repetitive motion back and forth around a horizontal axis of rotation.

As used herein, "hall sensor" or "hall effect sensor" may refer to a device that is used to measure the magnitude of a magnetic field. Hall effect sensors may be used for proximity sensing, positioning, speed detection, and current sensing applications. In some embodiments, the hall effect sensor may be positioned to sense a change in magnetic field strength as one or more magnets move past the sensor or as a moving metal component alters the strength of a magnetic field.

As used in this disclosure, the word "lateral" may refer to the sides of an object or movement towards a side. Lateral directions are generally perpendicular to longitudinal directions. "Laterally" may refer to movement in a lateral direction.

As used herein, the word "longitudinal" or "longitudinally" may refer to a lengthwise or longest direction.

As used herein, a "longitudinal edge" or "longitudinal end" may be an edge or end that is reached when traversing an object in a longitudinal direction.

As used in this disclosure, a "motor" may refer to a device that transforms energy from an external power source into mechanical energy.

As used in this disclosure, a "sensor" may be a device that quantitatively measures a physical stimulus.

As used in this disclosure, a "servo motor" may be an electrical motor that further incorporates a feedback circuit that allows for the angular positioning of the electric motor.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A programmable rocking bed comprising:

a mattress support box, a plurality of jacks, a base box frame, a mattress, a headboard, a footboard, a controller, a plurality of light strips, and one or more sound systems;

wherein the mattress support box is movable via the activation of the plurality of jacks;

wherein the plurality of jacks are operable to create a static or a dynamic motion thereby repositioning of the mattress support box as well as the mattress resting on the mattress support box;

wherein the mattress support box supports the mattress in a position elevated above a supporting surface;

wherein the mattress is adapted for a user to lay upon;

wherein a member is provided for each of the plurality of jacks;

wherein the member enables swaying motion of the mattress support box to occur relative to the respective jack of the plurality of jacks in order to simulate a rocking motion;

wherein the plurality of jacks comprises a left foot jack, a right foot jack, a left head jack, and a right head jack;

wherein the left foot jack is located under the left, foot of the mattress support box;

wherein the top of the left foot jack couples to a left foot member that also connects to the bottom of the mattress support box;

wherein a hall sensor located on the servo motor of each of the individual jacks provides inputs to the controller regarding the position of the servo motor, rotational speed of the servo motor, rotational direction of the servo motor, or combinations thereof;

wherein the plurality of light strips further comprise an indirect head wall light strip;

wherein the head wall light strip is coupled to the headboard and to the base box frame at a location behind the headboard such that the head wall light strip shines upon a wall that is adjacent the headboard;

wherein the one or more sound systems comprise a left sound system and a right sound system such that the audio program is played in stereo.

2. The programmable rocking bed according to claim 1 wherein the right foot jack is located under the right, foot of the mattress support box;

wherein the top of the right foot jack couples to a right foot member that also connects to the bottom of the mattress support box.

3. The programmable rocking bed according to claim 2 wherein the left head jack is located under the left, head of the mattress support box;

wherein the top of the left head jack couples to a left head member that also connects to the bottom of the mattress support box.

4. The programmable rocking bed according to claim 3 wherein the right head jack is located under the right, head of the mattress support box;

wherein the top of the right head jack couples to a right head member that also connects to the bottom of the mattress support box.

5. The programmable rocking bed according to claim 4 wherein an individual jack of the plurality of jacks comprises a servo motor and a scissor jack;

wherein the servo motor is energized with an electrical potential that turns the servo motor in a first rotational direction or a second rotational direction;

wherein the scissor jack raises the mattress support box when the servo motor turns in the first rotational direction;

wherein the scissor jack lowers the mattress support box when the servo motor turns in the second rotational direction.

6. The programmable rocking bed according to claim 5 wherein the electrical potential energizing the servo motor is pulsed to encode the direction and speed that the servo motor must turn.

7. The programmable rocking bed according to claim 5 wherein the servo motor turns a jack screw;

wherein the jack screw pulls the hinged center of a plurality of jack armatures together when the jack screw turns in the first rotational direction, causing the individual jack to gain height;

wherein the jack screw pushes the hinged center of the plurality of jack armatures apart when the jack screw turns in the second rotational direction, causing the individual jack to lose height.

8. The programmable rocking bed according to claim 7 wherein the elevation of a subset of the plurality of jacks is changed simultaneously to change an inclination angle or a tilt angle of the mattress support box.

9. The programmable rocking bed according to claim 7 wherein the elevation of the plurality of jacks is adjusted continuously to create the dynamic motion of the mattress.

10. The programmable rocking bed according to claim 7 wherein the controller operates the servo motors at each of the plurality of jacks, the plurality of light strips, and the one or more sound systems;

wherein the controller is adapted for the user to direct operation of the controller via a set of operator controls.

11. The programmable rocking bed according to claim 10 wherein the plurality of light strips are operable to alter lighting;

wherein the intensity and color of the plurality of light strips are established by the controller.

12. The programmable rocking bed according to claim 11 wherein the plurality of light strips comprise a left light strip, a right light strip, and the head wall light strip;

wherein the left light strip and the right light strip are coupled to the left and right side of the base box frame, respectively;

wherein the left light strip and the right light strip shine upon a floor beneath the mattress support box;

wherein the light from the plurality of light strips is configured to be visible to the user.

* * * * *